US009095007B2

(12) United States Patent
McGillycuddy

(10) Patent No.: US 9,095,007 B2
(45) Date of Patent: Jul. 28, 2015

(54) ROOF HEATING SYSTEM

(75) Inventor: Eugene B. McGillycuddy, Suffern, NY (US)

(73) Assignee: Augusta Glen Partners LLC., Mahwah, NJ (US)

( * ) Notice: Subject to any disclaimer, the term of this patent is extended or adjusted under 35 U.S.C. 154(b) by 0 days.

(21) Appl. No.: 13/441,444

(22) Filed: Apr. 6, 2012

(65) Prior Publication Data

US 2013/0055661 A1 Mar. 7, 2013

Related U.S. Application Data

(60) Provisional application No. 61/473,472, filed on Apr. 8, 2011.

(51) Int. Cl.
*H05B 3/34* (2006.01)
*E04D 13/10* (2006.01)

(52) U.S. Cl.
CPC ..... *H05B 3/34* (2013.01); *E04D 13/103* (2013.01); *H05B 2203/011* (2013.01); *H05B 2203/013* (2013.01); *H05B 2203/032* (2013.01); *H05B 2214/02* (2013.01)

(58) Field of Classification Search
CPC ..... E04D 13/10; E04D 13/103; E04D 13/106; E04D 13/076; E04D 13/0762; H05B 2214/02; H05B 6/06; H05B 3/36
USPC ..... 392/407, 432, 435
See application file for complete search history.

(56) References Cited

U.S. PATENT DOCUMENTS 2,546,743 A * 3/1951 Harrison ..... 219/547
2,912,555 A * 11/1959 Jamison ..... 392/435
3,129,316 A * 4/1964 Glass et al. ..... 219/213
3,691,343 A * 9/1972 Norman ..... 219/213
3,806,702 A * 4/1974 Spencer ..... 219/528
5,813,184 A * 9/1998 McKenna ..... 52/518
5,961,869 A * 10/1999 Irgens ..... 219/549
6,166,352 A * 12/2000 Turton ..... 219/213
6,184,495 B1 2/2001 Jones
6,184,496 B1 * 2/2001 Pearce ..... 219/213
6,215,102 B1 4/2001 Jones
6,297,475 B2 10/2001 Jones
6,489,594 B2 12/2002 Jones (Continued)

OTHER PUBLICATIONS

International Search Report Issued for PCT/US12/032552, dated Jul. 11, 2012 (2 pages).

*Primary Examiner* — Ryan Kwiecinski
(74) *Attorney, Agent, or Firm* — Wilmer Cutler Pickering Hale and Dorr LLP

(57) ABSTRACT

A heating system for use with roofing shingles, the heating system including a flexible grounding layer having a transverse dimension that is no greater than substantially equal to a transverse dimension of the roofing shingles, a flexible heater laminated to the flexible grounding layer, wherein the flexible heater includes a substrate, a conductive resistive ink pattern disposed on the substrate, wherein the ink pattern generates heat when electricity passes through the ink pattern, wherein the heating system includes a nailing portion that extends longitudinally along one side of the heating system, the nailing portion of the heating system having a transverse dimension that is at least substantially equal to a transverse dimension of a nailing portion of the roofing shingles, wherein the flexible heater is disposed on the flexible grounding layer such that the ink pattern is disposed outside of the nailing portion of the heating system.

18 Claims, 13 Drawing Sheets

(56) References Cited

U.S. PATENT DOCUMENTS

| | | | | |
|---|---|---|---|---|
| 6,708,452 | B1 * | 3/2004 | Tenute | 52/11 |
| 6,727,471 | B2 * | 4/2004 | Evans et al. | 219/213 |
| 6,847,018 | B2 * | 1/2005 | Wong | 219/549 |
| 6,875,954 | B2 | 4/2005 | DeBenedetto et al. | |
| 6,959,512 | B2 | 11/2005 | Cobb | |
| 6,978,577 | B2 | 12/2005 | Jones | |
| 7,071,446 | B1 * | 7/2006 | Bench | 219/213 |
| 8,158,231 | B2 * | 4/2012 | Hopkins et al. | 428/40.1 |
| 2002/0124476 | A1 | 9/2002 | Iannelli | |
| 2004/0004066 | A1 * | 1/2004 | Evans et al. | 219/213 |
| 2004/0195226 | A1 * | 10/2004 | Stabile | 219/213 |
| 2004/0244324 | A1 * | 12/2004 | McKenna | 52/533 |
| 2005/0210758 | A1 | 9/2005 | Iannelli | |
| 2006/0048456 | A1 | 3/2006 | Iannelli | |
| 2006/0289110 | A1 * | 12/2006 | Schmitt et al. | 156/250 |
| 2007/0012845 | A1 | 1/2007 | Iannelli | |
| 2008/0029654 | A1 | 2/2008 | Iannelli | |
| 2009/0031638 | A1 | 2/2009 | Iannelli | |
| 2014/0097178 | A1 * | 4/2014 | Whitcraft | 219/528 |
| 2014/0263266 | A1 * | 9/2014 | Jenkins et al. | 219/213 |

* cited by examiner

ROOF HEATING SYSTEM

CROSS-REFERENCE TO RELATED ACTIONS

This application claims the benefit of, prior U.S. Provisional Application No. 61/473,472 filed Apr. 8, 2011, which is incorporated by reference herein in its entirety.

BACKGROUND

Typically, in the construction of homes it is important to protect roofs from leaks due to ice and rain. Traditionally, felt paper was secured to wooden roofs underneath shingles. The felt paper would absorb ice or water that penetrated the shingles, preventing it from reaching the underlying wood. Nailing the felt paper to the roof, however, caused spaces around the nail through which water could seep. The water could follow the nail into the wood, causing leaks in the home. To solve this problem, water shields began to include an adhesive backing to fasten the shield to the wood, instead of using nails. The adhesive backing includes a peel-able strip which, when removed, exposes the adhesive layer for affixing the water shield to the unprotected wooden roof. The top of these water shields were made of a rubberized asphalt material, which created a gasket effect on the shaft of the nail driven through it. These water shields were successful in preventing many types of leaks.

In colder climates, however, ice dams can form and allow water to penetrate or flow under the water shield. For example, an ice dam can prevent melt-water from flowing downward off the roof, which can result in the water seeping into the house above the ice and water shield coverage area. Ice dams occur when snow accumulates on the roof of a house with inadequate insulation. Heat conducted through the insufficiently insulated roof, and warm air from the space below, warms the roof and melts the snow on areas of the roof that are above living spaces. It does not, however, melt the snow over cold areas, such as roof overhangs. In these situations, melt-water from the heated areas of the roof flows down the roof, under the blanket of snow, onto the overhang and into the gutter, where colder conditions permit it to freeze. Eventually, ice accumulates along the overhang and in the gutter. Snow that melts later cannot drain properly, backs up on the roof and can result in damaged ceilings, walls, roof structure, and insulation. To avoid this many building codes require a water shield covering the roof two feet into the living space.

SUMMARY

A heating system for use with roofing shingles, the heating system including a flexible grounding layer having a transverse dimension that is no greater than substantially equal to a transverse dimension of the roofing shingles, a flexible heater laminated to the flexible grounding layer, wherein the flexible heater includes a substrate, a conductive resistive ink pattern disposed on the substrate, wherein the ink pattern generates heat when electricity passes through the ink pattern, wherein the heating system includes a nailing portion that extends longitudinally along one side of the heating system, the nailing portion of the heating system having a transverse dimension that is at least substantially equal to a transverse dimension of a nailing portion of the roofing shingles, wherein the flexible heater is disposed on the flexible grounding layer such that the ink pattern is disposed outside of the nailing portion of the heating system.

Various aspects of the invention may provide one or more of the following capabilities. A radiant heat deicer can be provided. Radiant heat can be provided when desired to melt ice dams and/or snow. The amount of ice dam damage caused on a roof can be reduced. Icicles hanging from a roof can be reduced. Roofs can be protected from water and ice damage using radiant heat. Radiant heating can be installed along with shingles on a roof. The power consumed by a heating system can be reduced. Installation time of the heating system can be reduced. These and other capabilities of the invention, along with the invention itself, will be more fully understood after a review of the following figures, detailed description, and claims.

DETAILED DESCRIPTION

Embodiments of the invention can provide techniques for preventing and eliminating ice dams and snow buildup on roofs. A flexible layered heating system includes a grounding layer and a heating layer. The heating system can be sized such that its height is approximately the same as a standard shingle. In this configuration, the heating layer is only located in a bottom portion of the heating system so that when the heating system is installed under a layer of shingles, that the shingles can be nailed to the roof using common construction techniques without damaging the heating layer. The heating system can be rolled out onto a roof before a subsequent course of shingles is nailed to the roof. A heating system can be installed under one or more courses of shingles on a roof, as desired to melt snow and ice. The heating system can also be controlled by an automated controller that senses temperature, moisture, and/or precipitation. Other embodiments are within the scope of the invention.

Figure 1:
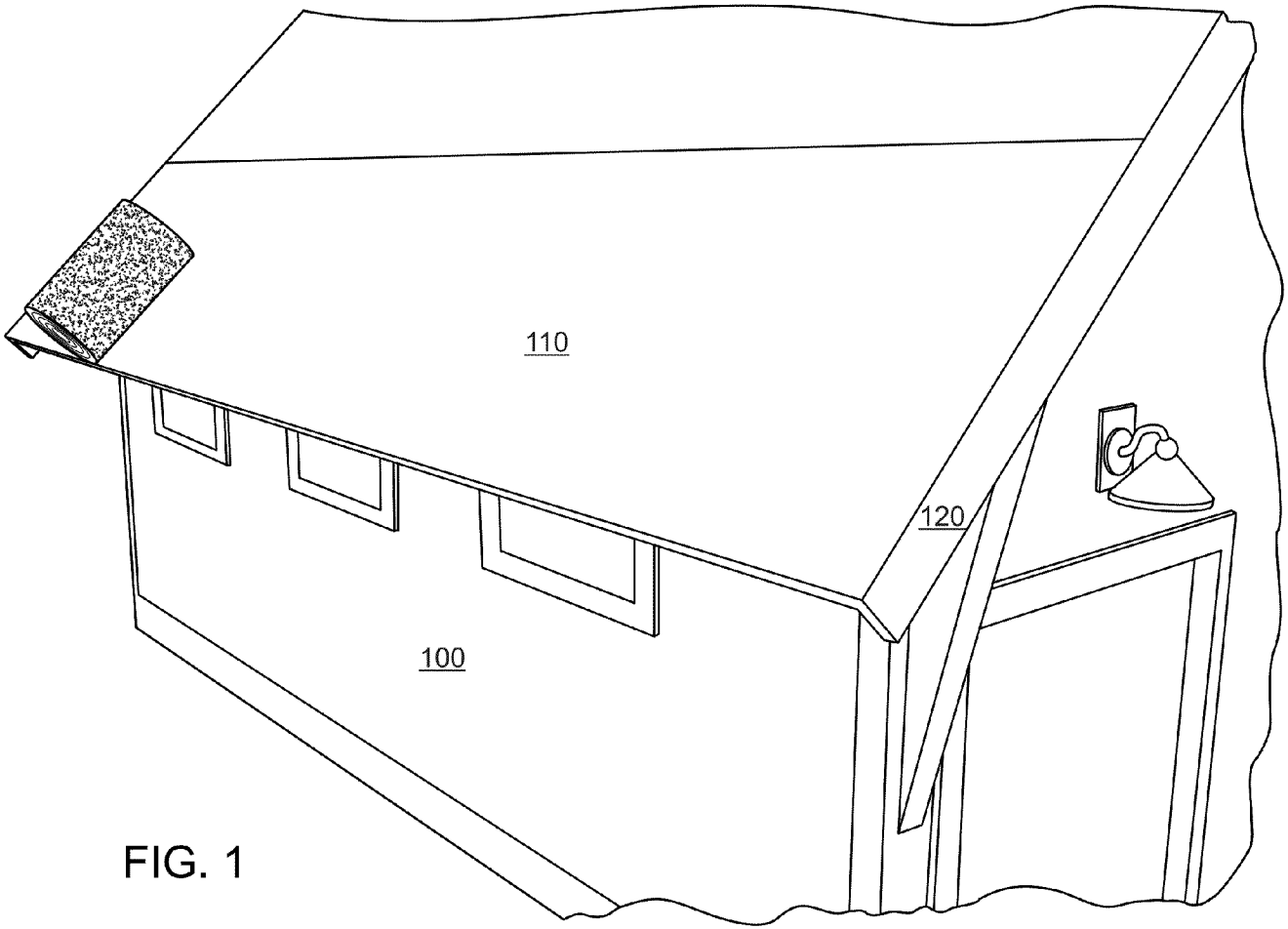
FIG. 1 shows a wooden roof without an ice and water shield or shingles.

Referring to FIG. 1, a house 100 is shown with an unprotected wooden roof 110. The wooden roof 110 includes an overhang 120 that extends beyond a heated living area of the house 100. Overhang 120 is typically an area where ice dams can form. Typically, the roof 110 is covered with shingles, such as standard asphalt shingles, although other types of shingles can be used (e.g., wood, clay, etc.).

Figure 2:
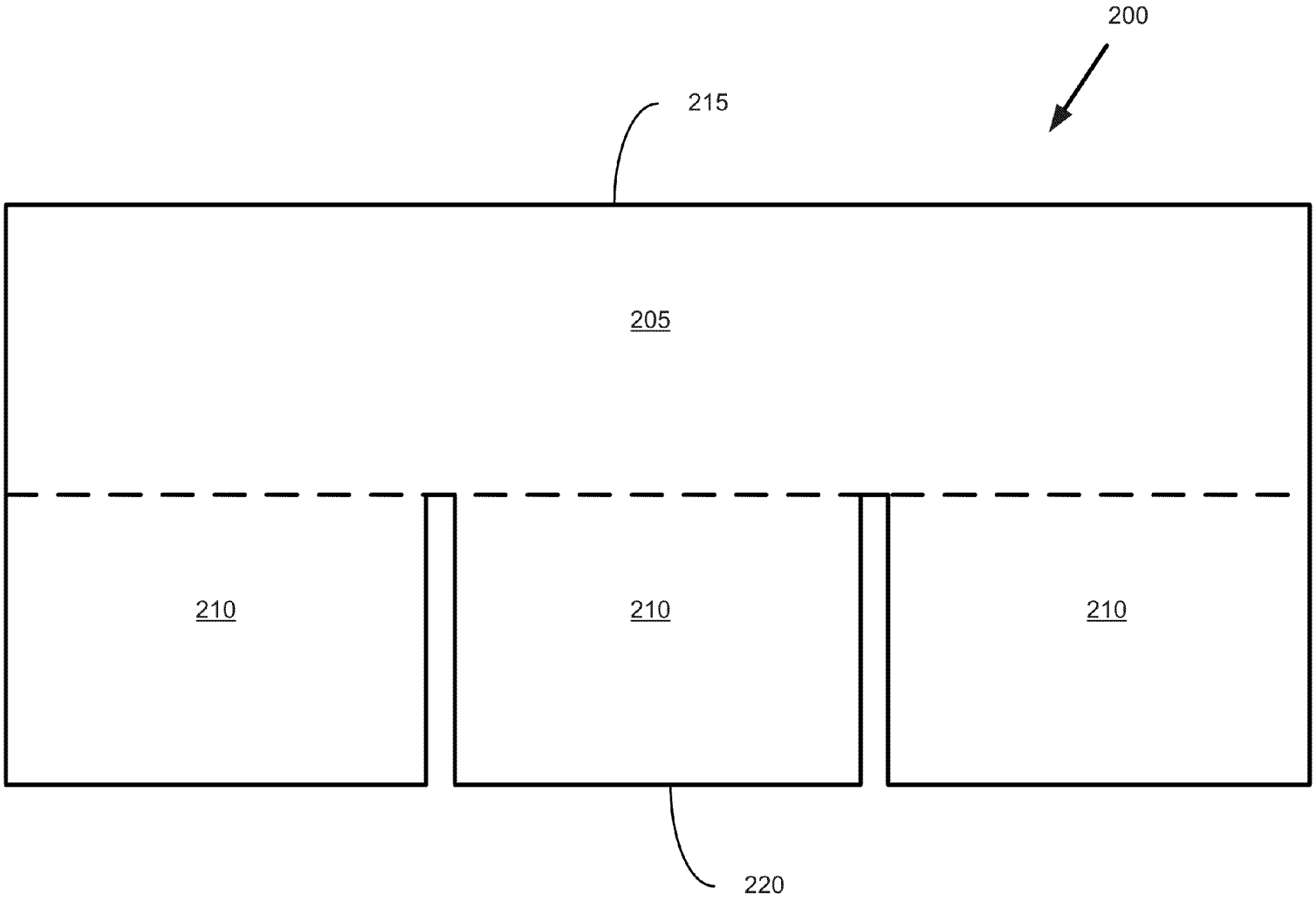
FIG. 2 shows a standard 3-tab shingle.
Figure 3:
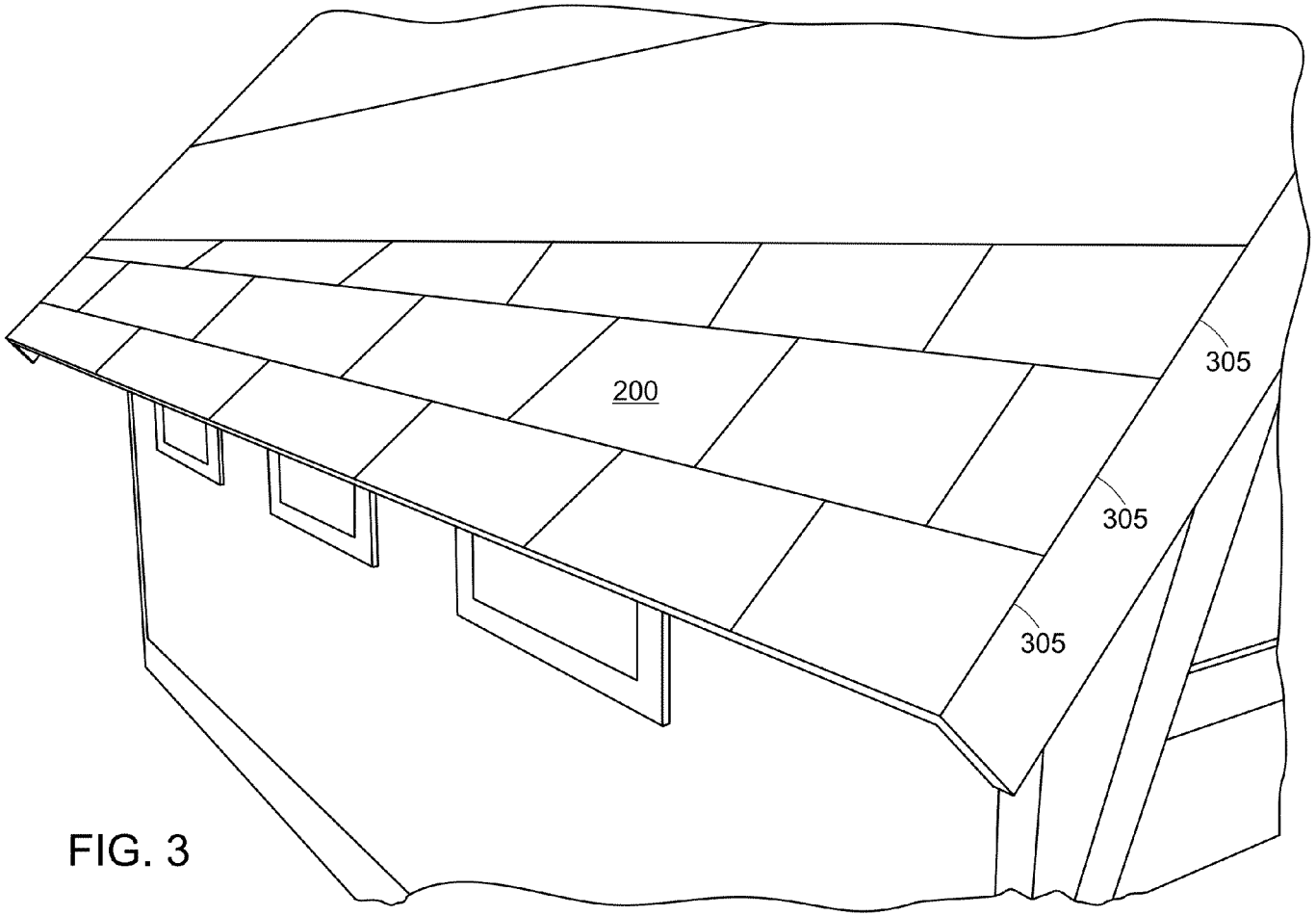
FIG. 3 shows a wooden roof with several courses of shingles attached.

Referring to FIGS. 2-3, a standard 3-tab shingle 200 is shown. The shingle 200 includes a nailing portion 205, and three tabs 210. In a typical installation, shingles 200 are applied to the roof 110 in a series of rows called courses (e.g., 305 in FIG. 3). Typically, a starter course of shingles is nailed to the roof 110 in such a manner that a top 215 of the shingle is even with the bottom of the roof 110 (e.g., the first starter course of shingles is installed upside down). In some embodiments, the tabs 210 may be cut off the starter course. A first course is then applied on top of the starter course such that a bottom 220 of the shingle is even with the bottom of the roof 110 (e.g., the first course can be applied directly on top of the starter course). In order to cover the rest of the roof 110, subsequent courses of the singles 200 are applied in a partially-overlapping manner such that the tabs 210 of one course of shingles are placed over the nailing portion 205 of the course below it.

Figure 4:
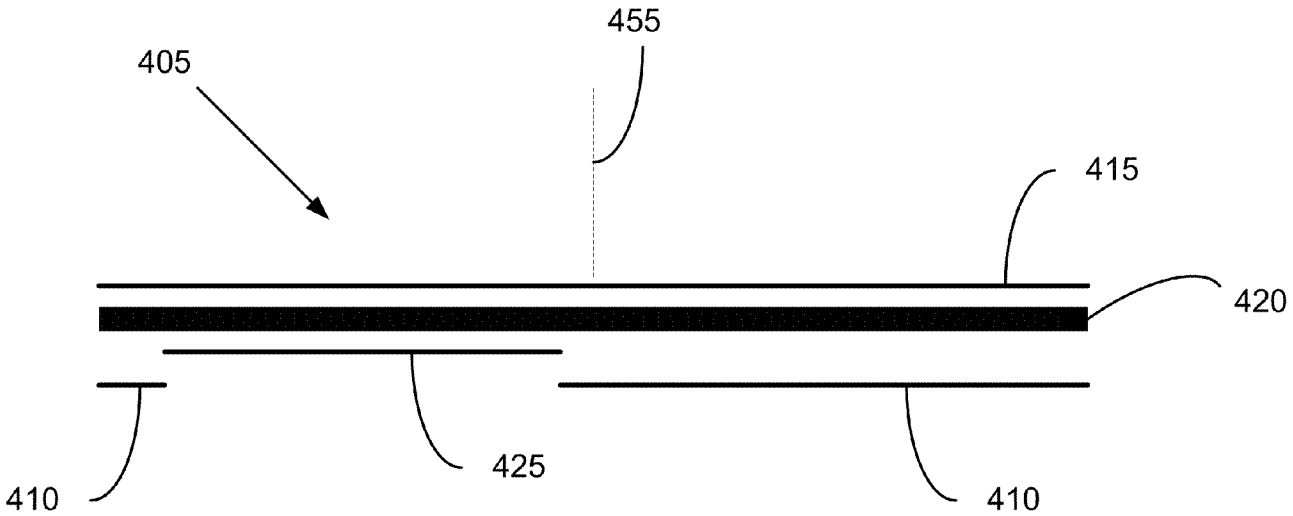
FIG. 4 is an exploded cross-sectional view of the heating system shown in FIG. 5, taken along line I-I in FIG. 5.
Figure 5A:
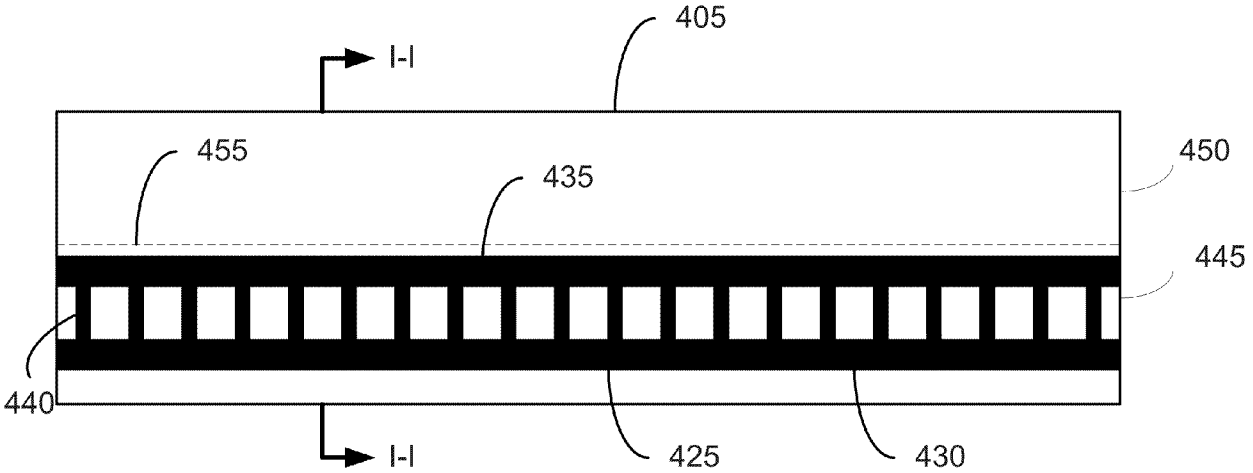
FIG. 5A is an exemplary heating system.
Figure 5B:
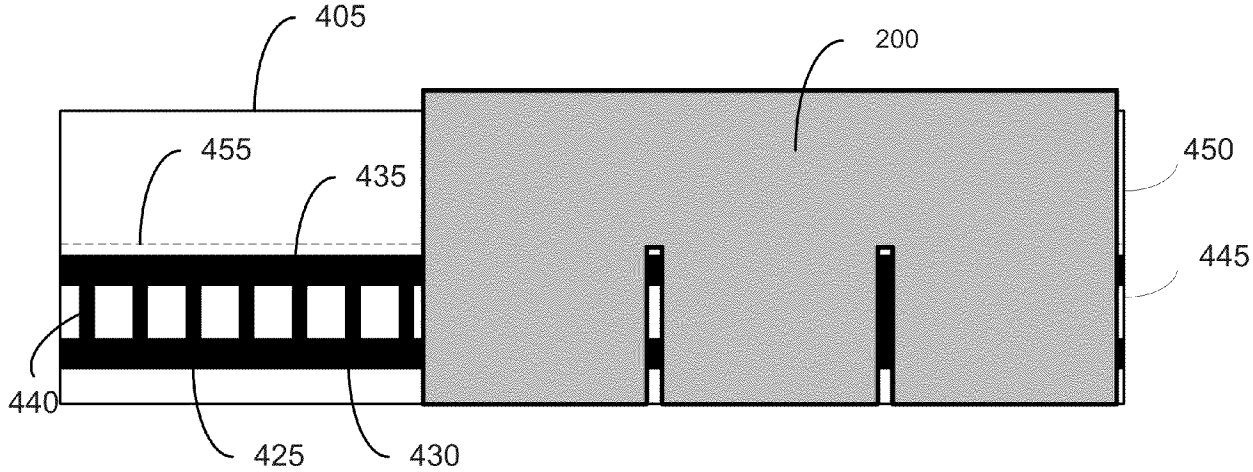
FIG. 5B is a shingle overlaid on an exemplary heating system.

Referring to FIGS. 4-5, an embodiment of a heater system that can be used to prevent ice dams is shown. Heating system 405 can be a flexible laminated continuous sheet heater that includes a ground shield 415, an adhesive layer 420, and a heater 425. The ground shield 415 can be aluminum (e.g., aluminum foil), although other grounding materials can be used. Preferably, the ground shield is configured such that a nail can be hammered through it. The adhesive layer 420 is preferably construction grade adhesive that can bond to underlayments such as plywood, ice dam barrier, and asphalt shingles and can permanently bond the heater 425 to the ground shield 415. In embodiments where the heater 425 is smaller than the ground shield 415 leaving exposed adhesive 420 (e.g., as shown in FIG. 4), the exposed adhesive can be covered by a release liner (e.g., poly or kraft paper 410) that can be removed before installation. The adhesive can be used to adhere the heating system 405 to the shingles and/or plywood roof. In one embodiment, the ground shield 415 is 0.003 to 0.005 inches thick, the adhesive layer 420 is 0.04 to 0.08 inches thick, and the heater 425 is 0.014 inches thick. Preferably the heater 425 is configured to operate at 6-14 watts per linear foot. Other thicknesses and wattages are possible.

Figure 6:
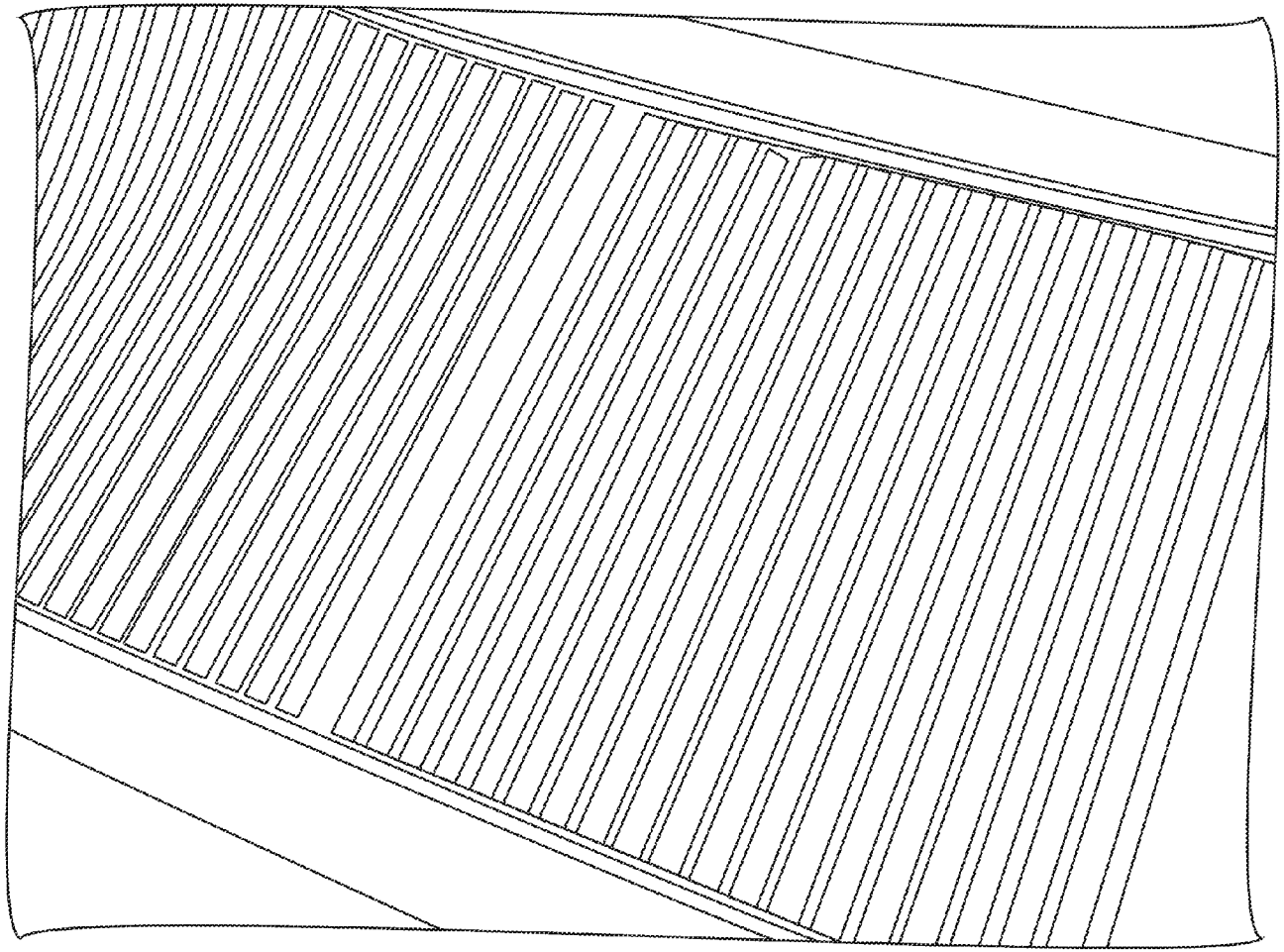
FIG. 6 is an example of part of the heating system shown in FIG. 5.

The heater 425 can be a plastic substrate on which is printed heating element 430, although other substrates are possible (e.g., rubber, metal). For example, the heater 425 can be a pattern of conductive resistive ink that generates heat as electricity passes through it (e.g., via Joule heating). The heater 425 can include i) a pair of longitudinal stripes 435 extending parallel to and spaced apart from each other and ii) a plurality of bars 440 spaced apart from each other and extending between and electrically connected to the stripes 435. In this configuration, one of the longitudinal stripes 435 can act as a positive bus, and the other longitudinal stripe 435 can act as an negative bus, thus causing a flow of electricity through the bars 440. An embodiment of the heater 425 is described more fully in each of the following U.S. Pat. No. 4,485,297, and U.S. Pat. No. 4,733,059 each of which are incorporated by reference herein. Other configurations of the heater 425 are possible. A photograph of one embodiment of the heater 425 is shown in FIG. 6.

The spacing of the bars 440 can be configured to cause substantially uniform heating. For example, the width of each bar 440 can be greater than the space between adjacent bars, and the space between bars 440 can be less than an inch, preferably in the range of about ⅛" to 1". The widths of the heating bars is typically in the range of about ⅛" to about 2", preferably about ¼" to ½", although other widths are possible. Other pattern designs for the arrangement of the heater 425 are possible, such as those disclosed in U.S. Pat. No. 4,485,297, which is incorporated by reference herein in its entirety.

The heater 425 can also contains electrodes connected to copper strips extending from an end of the longitudinal stripes 435. Generally, as described in U.S. Pat. No. 4,485,297, the electrodes can provide an electrical connection between the heater 425 and a control unit, which can be, in turn, connected to a power source.

The heating system 405 can be approximately the same height as a standard asphalt shingle (e.g., 13¼ inches), although other sizes are possible. The heating system 405 can be divided into two portions: a heater portion 445 and a nailing portion 450. The heating system 405 can be configured such that the nailing portion 450 is the top half of the heating system 405, and the heater portion 445 is the bottom half of the heating system 405 (e.g., above and below line 455). The heating system 405 can be configured such that the heater portion 445 is approximately the same size as the tabs 210 of the shingle 215, and the nailing portion 450 is approximately the same size as the nailing portion 205 of the shingle 215.

Figure 7:
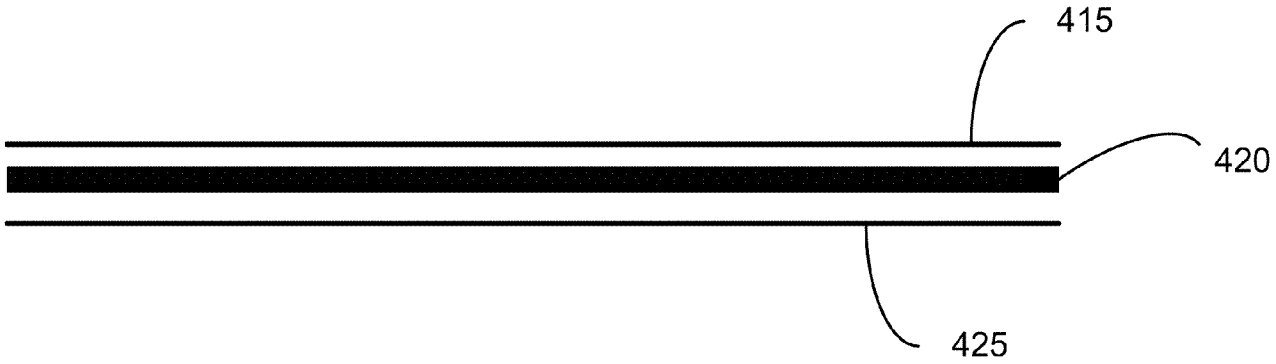
FIG. 7 is an exemplary exploded cross-sectional view of a heating system

The heater 425 of the heating system 405 can be configured in various manners. For example, the plastic substrate of the heater 425 can be approximately the same size as the conductive pattern printed thereupon (e.g., as shown in FIG. 4), or the plastic substrate can be much larger providing additional surface area to install the heating system 405. To the extent that the plastic substrate is sized such that it extends into the nailing portion 450 (e.g., as shown in FIG. 7), preferably the conductive pattern printed thereupon does not extend into the nailing portion 450.

Figure 8:
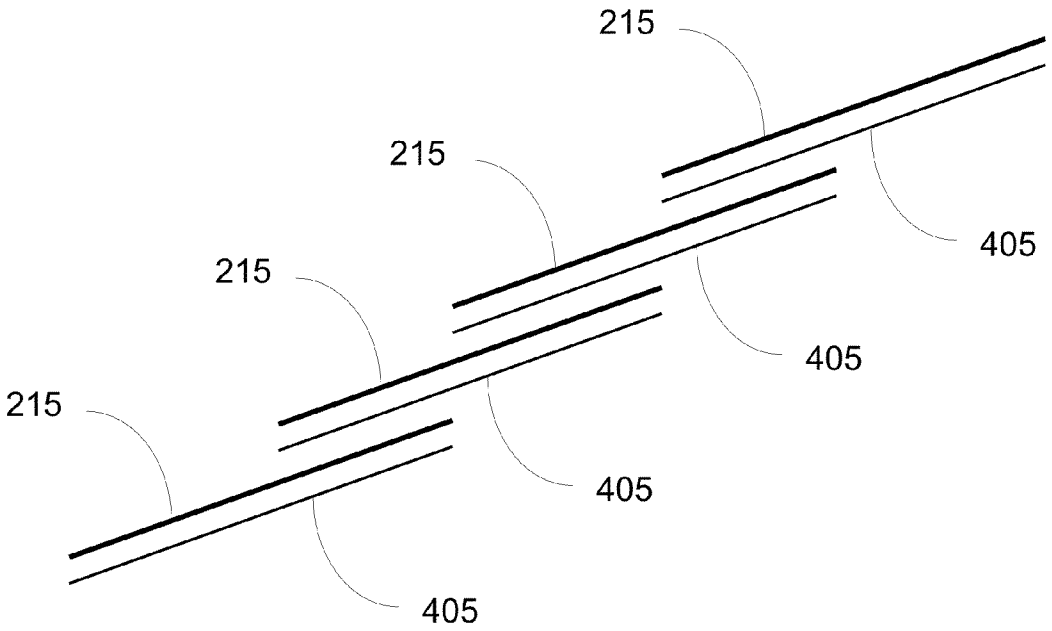
FIG. 8 is an exemplary technique of installing courses of shingles and heating systems.

The heating system 405 can be installed on a roof such that it melts snow and ice that accumulates on the roof. Referring to FIG. 8, preferably one of the heating system 405 is installed for each course of shingles 215 that is installed on the roof. The heating system 405 is preferably installed under each corresponding course of shingle. The heating system 405 can be installed on only the first few courses (e.g., where ice dams a likely to form), or can be applied on the entire roof. The heating system 405 can also be sized such that it can be placed in each course of the peaks and valleys that are found in complicated roof designs. In another embodiment, the heating system 405 can be large enough to cover multiple courses (e.g., with alternating heating and nailing portions). In this embodiment, the heating system 405 can be placed directly on the roof, rather than under each course of shingles. In another embodiment, the heating system 405 can also be placed in other locations such as the point above an exterior and/or interior wall.

Figure 9:
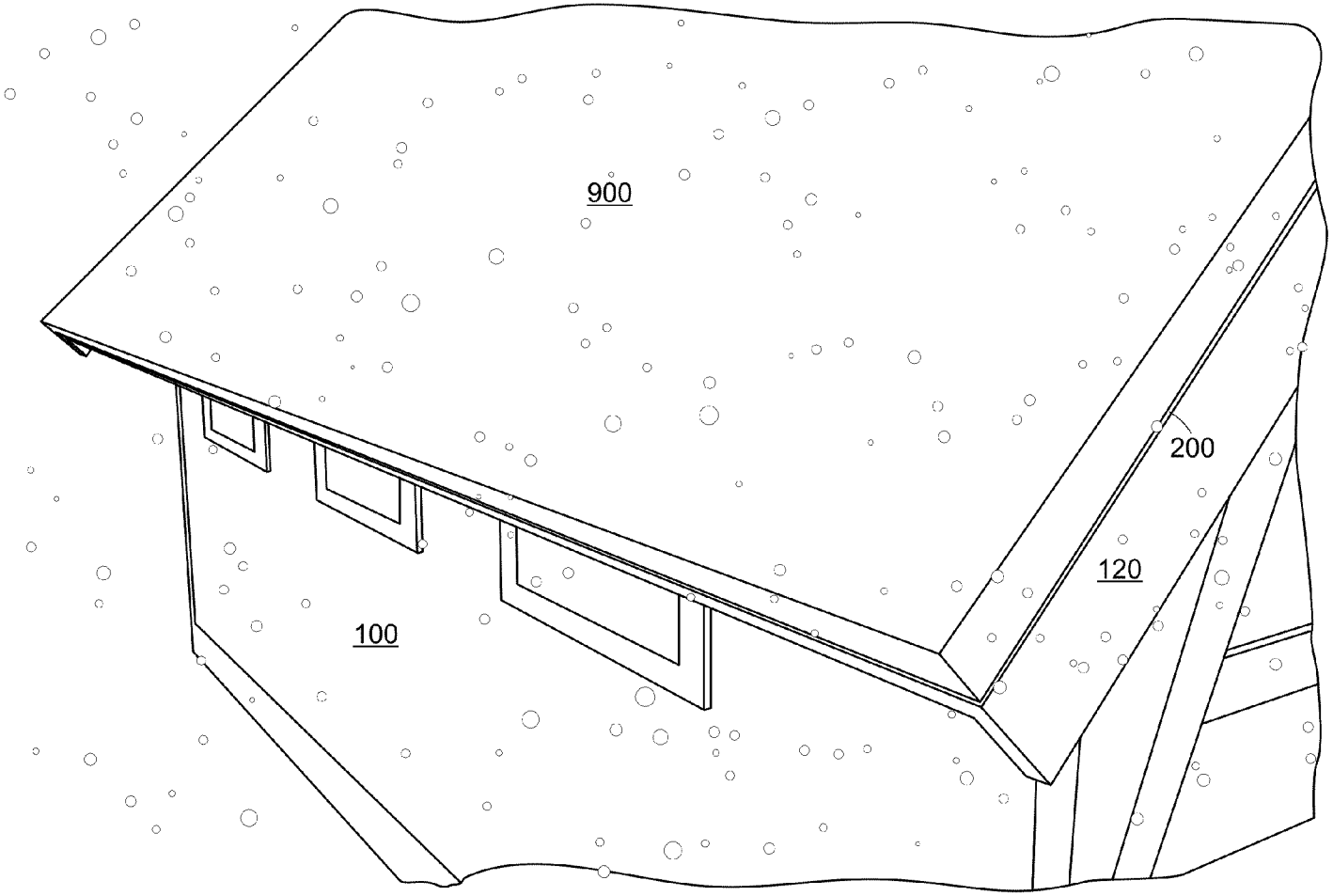
FIG. 9 shows a wooden roof with snow on top.

Referring to FIG. 9, snow 900 covers the roof of house 100. Directly beneath the snow 900 is weather resistance protective covering, such the shingles 200. As discussed above, below each course of shingles is the heating system 405. It is worth noting that snow 900 covers both overhang 120, as well as areas of the roof extending inwardly from the overhang to above the heated living areas of house 100.

Figure 10:
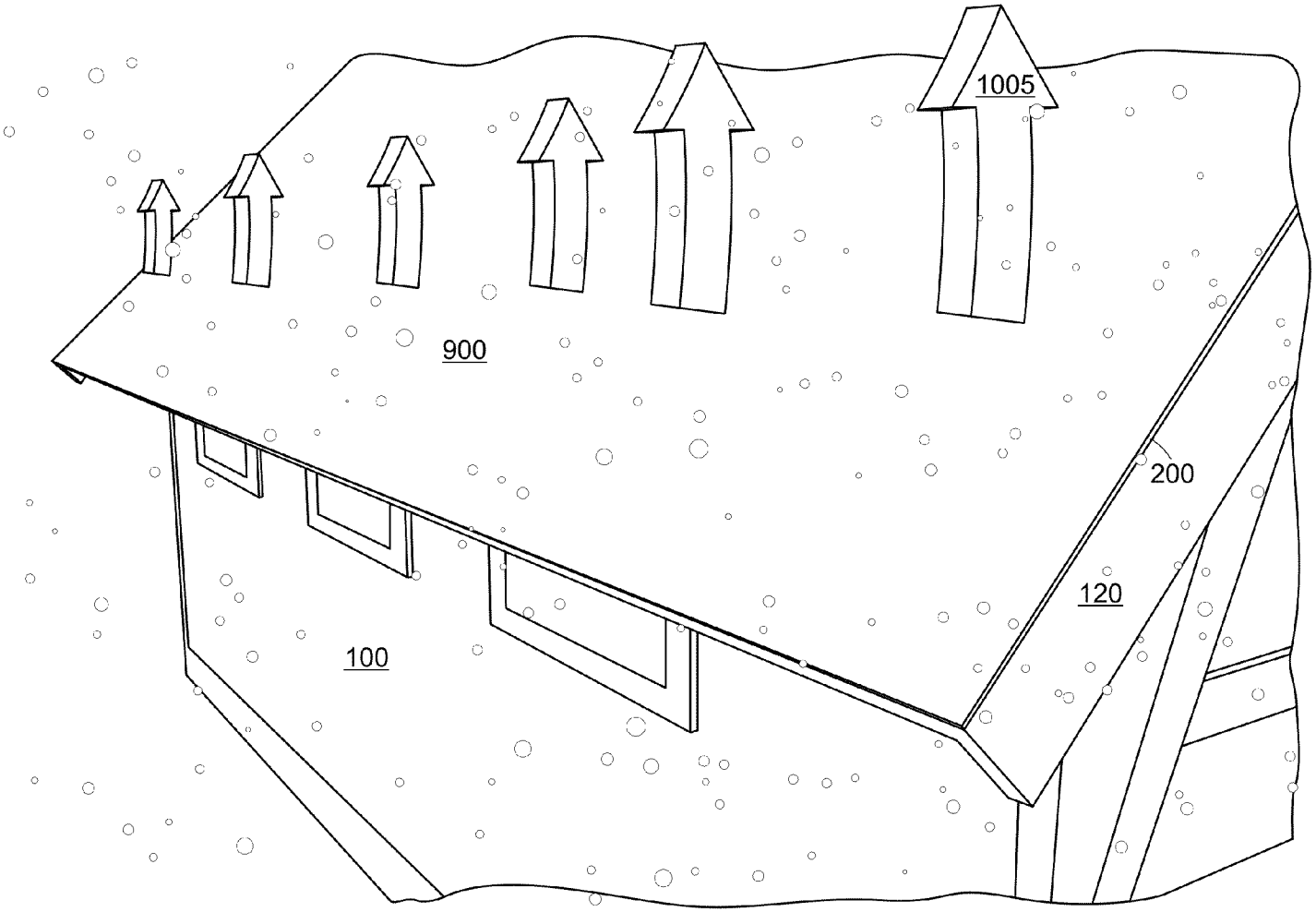
FIG. 10 shows heat radiating through the snow on the wooden roof shown in FIG. 9.

Referring to FIG. 10, radiant heat 1005 provided by heating system 405 can be seen radiating upwards up through snow 900. Radiant heat 1005 heats the area above the heating system 405, which includes the area above overhang 120. Preferably, the heating system 405 (made up of multiple courses, if desired) extends from the edge of overhang 120 up the pitch of the roof to a portion above the heated living areas of home 100 (typically 2' into the heated living space). Radiant heat 1005 therefore melts snow 900, while also preventing melt-water from the top of the roof from re-freezing on or near overhang 120.

Figure 11:
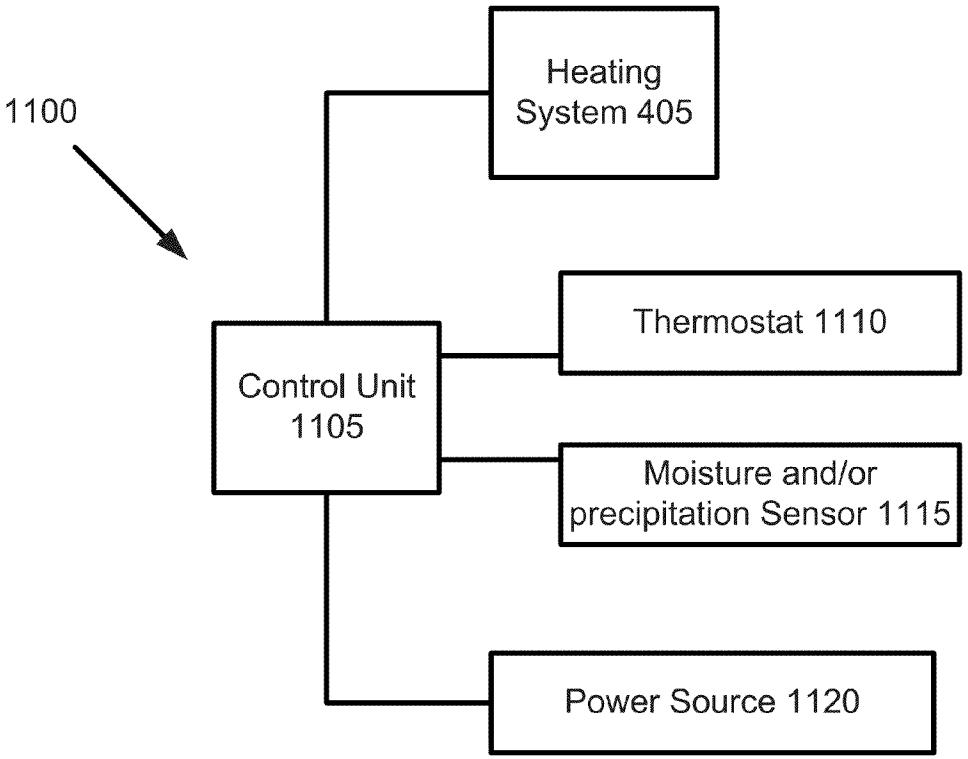
FIG. 11 is an exemplary system with a control unit.

Referring to FIG. 11, a system 1100 includes the heating system 405, control unit 1105, a thermostat 1110, and a moisture and/or precipitation sensor 1115. The heating system 405 can be controlled by control unit 1105. The control unit 1105 is preferably installed in an area of house 100 not exposed to the elements, and is electrically connected to the heating system 405. The control unit 1105 can be connected to the heating system 405, the thermostat/sensor 1110, the moisture/precipitation sensor 1115, and a power source 1120. The thermostat/sensor 1110 can be part of the control unit 1105, or can be a separate unit that connects to the control unit 1105. In addition, while shown separately, the thermostat/sensor 1110 and moisture/precipitation sensor 1115 can be combined in a single sensor unit. Preferably, the thermostat/sensor 1110 and moisture/precipitation sensor 1115 are installed at the coldest area around the gutter of the house, in a place that is not subject to direct sunlight to ensure that when the moisture/precipitation sensor 1115 is dry, the entire gutter area is dry. In this position, thermostat/sensor 1110 can also determine the ambient air temperature. Control unit 1105 can use information from thermostat/sensor 1110 and moisture/precipitation sensor 1115 to make a determination as to whether power should be supplied to the heating system 405. While the moisture/precipitation sensor 1115 is described as being a combined sensor, another configuration is a sensor that only detects moisture or only detects precipitation.

Figure 12:
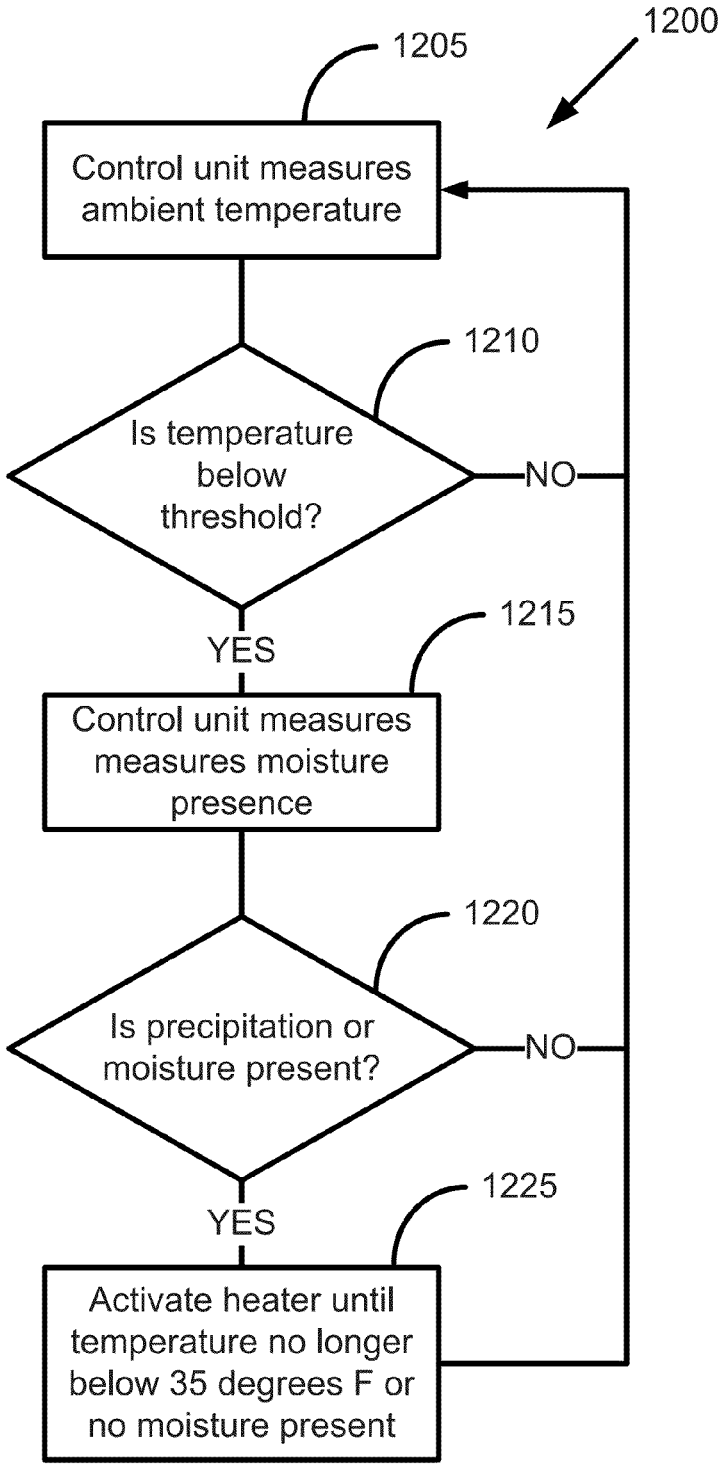
FIG. 12 is an exemplary process of controlling a heating system.

In operation, referring to FIG. 12, with further reference to FIGS. 1-11, a process 1200 for controlling the heating system 405 using the control unit 1105 includes the stages shown. The process 1200, however, is exemplary only and not limiting. The process 1200 may be altered, e.g., by having stages added, changed, removed, or rearranged. The process 1200 can be i) continuously run so that the heating system 405 is always ready, ii) run at specified intervals (e.g., every 20 minutes), and iii) at the direction of an operator.

At stage 1205, the control unit 1105 measures outside air temperature. This can be done by measuring the ambient temperature with thermostat/sensor 1110.

At stage 1210, the control unit 1105 then determines whether the ambient temperature is at or below a predetermined threshold. For example, the control unit can determine if the temperature is at or below 32 degrees Fahrenheit. In other embodiments, the temperature can be set a few degrees higher than freezing, such as 35 degrees Fahrenheit. If the temperature is at or below the predetermined threshold, the process 1200 continues to stage 1215, otherwise the process 1200 continues to stage 1205.

At stage 1215/1220, the control unit 1105 uses moisture/precipitation sensor 1115 to determine if the sensed moisture and/or precipitation level is at or above a predetermined threshold. If the moisture and/or precipitation level is above the threshold, the process 1200 continues to stage 1225, otherwise the process continues to stage 1205

At stage 1225, the control unit 1105 activates the heating system 405 by supplying power from power source 1120. The control unit 1105 preferably keeps the heating system 405 activated until the precipitation and/or moisture level falls below the predetermined threshold, and/or the temperature exceeds the predetermined threshold. The control unit 1105 can also be configured to activate the heating system 405 for a predetermined time period (e.g., 2 hours) after the temperature and moisture/precipitation thresholds are triggered.

The process 1200, vis-a-vis the two-step determination of temperature and moisture/precipitation, can reduce the amount of power consumed by the heating system 405 to prevent the formation of ice dams. If the temperature is above the freezing point in step 1210, e.g., 50 degrees Fahrenheit, then there is little concern that snow or melt-water will freeze at overhang 120, forming an ice dam. Therefore, the continuous sheet heater does not need to be operated. Turning the sheet heater on or off can be accomplished by simply providing power to the heating system 405 or preventing power from being supplied to the heating system 405, in accordance with the sensed conditions as described above. Further, if the temperature is determined to be at or below 35° F. in step 1210, no ice or water will freeze to form an ice dam, if no precipitation and/or moisture is detected in step 1220. Accordingly, heating system 405 should not be active. In the event that the temperature is at or below the freezing point and moisture is detected, than the formation of an ice dam is possible. To prevent the formation of the ice dam, the heating system 405 can be activated by control unit 1105.

The process 1200 and the controller 1100 are preferably configured to operate without any intervention by a user. For example, a homeowner can configure the controller 1100 once, and can the controller 1100 can preferably function without any further input by the homeowner.

Figure 13:
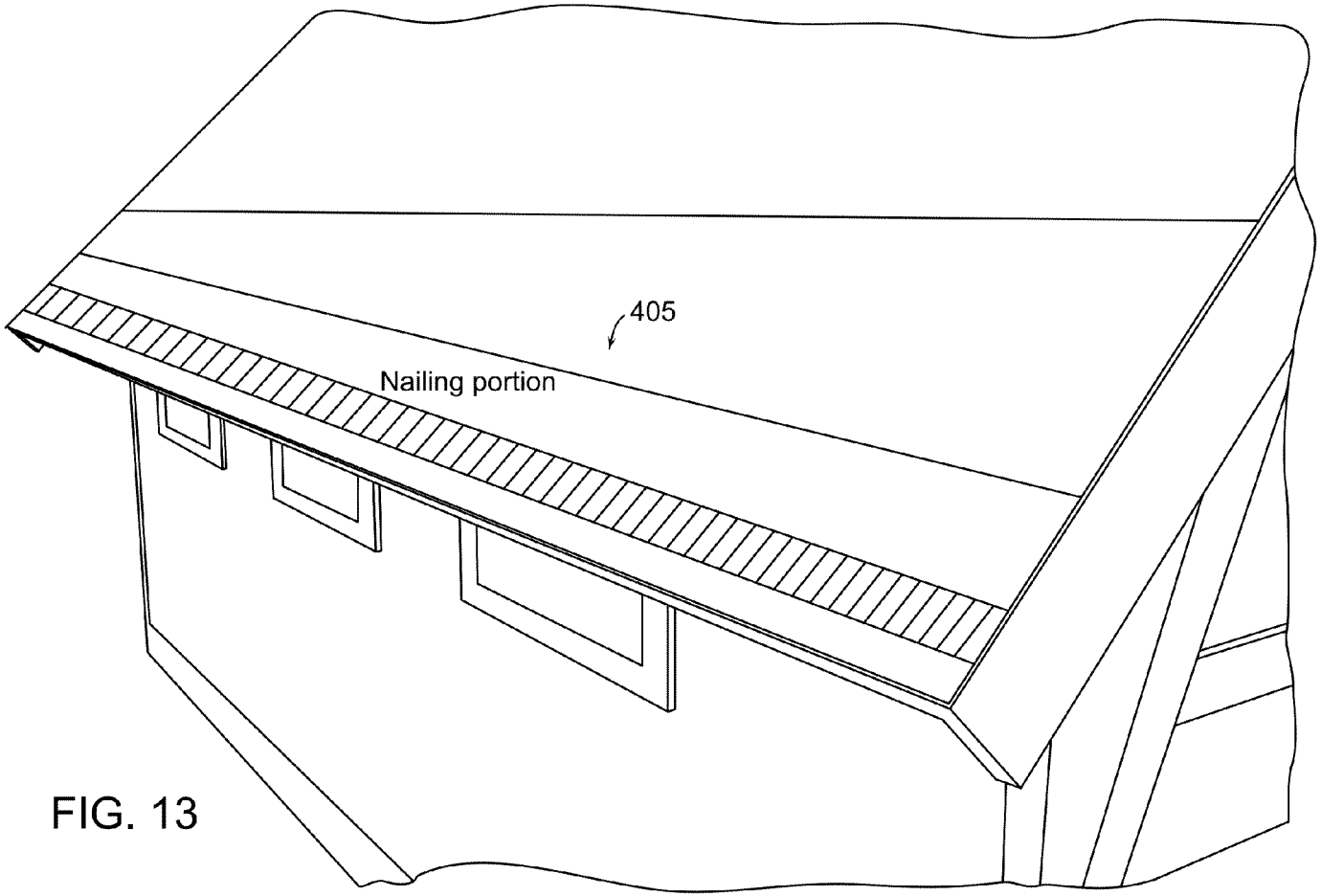
FIG. 13 shows an exemplary installation of a heating system on a roof.

Referring to FIG. 13, an exemplary installation of the heating system 405 is shown. For example, the heating system 405 can be installed on top of standard ice and water shield using adhesive and/or nails before the starter course of shingles is applied. Subsequent courses of the heating system can then be installed as desired.

Other embodiments are within the scope and spirit of the invention. For example, while the foregoing description has focused on the heating system 405 being used to prevent/remove ice dams, the heating system 405 can also be configured to melt snow off of an entire roof (e.g., when snow weight is a concern). In addition, instead of using the process 1200, the heating system 405 can be controlled manually.

The subject matter described herein can be implemented in digital electronic circuitry, or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, subprograms, or portions of code). A computer program can be deployed to be executed on one computer or on multiple computers at one site or distributed across multiple sites and interconnected by a communication network.

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices); magnetic disks, (e.g., internal hard disks or removable disks); magneto-optical disks; and optical disks (e.g., CD and DVD disks). The processor and the memory can be supplemented by, or incorporated in, special purpose logic circuitry.

To provide for interaction with a user, the subject matter described herein can be implemented on a computer having a display device, e.g., a CRT (cathode ray tube) or LCD (liquid crystal display) monitor, for displaying information to the user and a keyboard and a pointing device, (e.g., a mouse or a trackball), by which the user can provide input to the computer. Other kinds of devices can be used to provide for interaction with a user as well. For example, feedback provided to the user can be any form of sensory feedback, (e.g., visual feedback, auditory feedback, or tactile feedback), and input from the user can be received in any form, including acoustic, speech, or tactile input.

The subject matter described herein can be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

It is noted that one or more references are incorporated herein. To the extent that any of the incorporated material is inconsistent with the present disclosure, the present disclosure shall control. Furthermore, to the extent necessary, material incorporated by reference herein should be disregarded if necessary to preserve the validity of the claims.

To the extent certain functionality or components "can" or "may" be performed or included, respectively, the identified functionality or components are not necessarily required in all embodiments, and can be omitted from certain embodiments of the invention.

Further, while the description above refers to the invention, the description may include more than one invention.

What is claimed is:

1. A heating system, the heating system comprising:

a flexible grounding layer made of a continuous piece, the flexible grounding layer having a nailing portion;

an adhesive layer disposed on the flexible grounding layer;

a flexible heater disposed on a first portion of one adhesive surface of the adhesive layer, wherein the flexible heater comprises a substrate and a conductive resistive ink pattern disposed on the substrate, wherein the ink pattern generates heat when electricity passes through the ink pattern; and a controller configured to control a flow of electricity to the flexible heater as a function of a temperature and at least one of a moisture level and a precipitation level;

wherein the flexible heater is disposed on the first portion of one adhesive surface of the adhesive layer, which is disposed on the flexible grounding layer, such that the ink pattern is disposed outside of the nailing portion of the flexible grounding layer; and wherein a second portion of the one adhesive surface of the adhesive layer is configured to adhere to at least one of a roofing shingle and a roof.

2. The heating system of claim 1 wherein the flexible grounding layer is aluminum foil.

3. The heating system of claim 1 wherein the second portion of the one adhesive surface of the adhesive layer is covered by a release liner that is configured to be removed before installation.

4. The heating system of claim 1 wherein the ink pattern comprises:

a pair of longitudinal stripes spaced apart from each other; and a plurality of transverse bars configured to be spaced apart from each other to cause substantially uniform heating and extending between the longitudinal stripes.

5. The heating system of claim 1, wherein the flexible grounding layer has a transverse dimension that is no greater than a transverse dimension of the roofing shingle.

6. The heating system of claim 1, wherein the nailing portion of the flexible grounding layer has a transverse dimension that is at least equal to a transverse dimension of a nailing portion of the roofing shingle.

7. The heating system of claim 1, wherein the controller turns on the flow of electricity only if at least one of moisture and precipitation is present and the temperature is below a predetermined threshold.

8. The heating system of claim 7, wherein the predetermined threshold is 35 degrees Fahrenheit.

9. The heating system of claim 1, wherein the controller is configured to control the flow of electricity at least one of (i) continuously, (ii) at specified intervals, and (iii) at the direction of an operator.

10. A heated roofing system comprising:

a plurality of courses of shingles disposed on an underlayment, the plurality of courses of shingles extending from a bottom to a top of a roof;

a heating system disposed between the underlayment and a subset of shingles of the plurality of courses of shingles, the heating system comprising a flexible grounding layer made of a continuous piece, an adhesive layer disposed on the flexible grounding layer, and a flexible heater disposed on a first portion of one adhesive surface of the adhesive layer, the heating system configured to provide heat to the subset of shingles; and a controller configured to control a flow of electricity to the heating system as a function of a temperature and at least one of a moisture level and a precipitation level;

wherein the heating system includes a nailing portion that extends longitudinally along one edge of the heating system; and wherein a second portion of the one adhesive surface of the adhesive layer is configured to adhere to at least one of the subset of shingles and the underlayment.

11. The heated roofing system of claim 10 wherein the subset of shingles is disposed on an overhang of the roof.

12. The heated roofing system of claim 10 wherein the heating system comprises a heating element including conductive resistive ink.

13. The heated roofing system of claim 12 wherein the second portion of the one adhesive surface of the adhesive layer is covered by a release liner that is configured to be removed before installation.

14. The heated roofing system of claim 10, wherein the flexible grounding layer has a transverse dimension that is no greater than a transverse dimension of a shingle of the subset of shingles.

15. The heated roofing system of claim 10, wherein the nailing portion has a transverse dimension that is at least equal to a transverse dimension of a nailing portion of a shingle of the subset of shingles.

16. The heated roofing system of claim 10, wherein the controller turns on the flow of electricity only if at least one of moisture and precipitation is present and the temperature is below a predetermined threshold.

17. The heated roofing system of claim 15, wherein the predetermined threshold is 35 degrees Fahrenheit.

18. The heated roofing system of claim 10, wherein the controller is configured to control the flow of electricity at least one of (i) continuously, (ii) at specified intervals, and (iii) at the direction of an operator.

* * * * *